US006070790A

United States Patent [19]

Anderson

[11] Patent Number: 6,070,790

[45] Date of Patent: Jun. 6, 2000

[54] TAMPER EVIDENT CARTON SEAL

[75] Inventor: Jeff Anderson, New Market, Canada

[73] Assignee: Colgate-Palmolive Company, New York, N.Y.

[21] Appl. No.: 08/906,783

[22] Filed: Aug. 6, 1997

[51] Int. Cl.[7] ..... B65D 5/00

[52] U.S. Cl. ..... 229/102; 229/134; 229/136; 206/807

[58] Field of Search ..... 229/102, 136, 229/134, 132; 206/807

[56] References Cited

U.S. PATENT DOCUMENTS

| | | | |
|---|---|---|---|
| 837,324 | 12/1906 | Mitchell . | |
| 2,005,131 | 6/1935 | De Luce | 229/134 X |
| 2,084,106 | 6/1937 | Palmer et al. . | |
| 2,330,478 | 9/1943 | Englert | 229/102 X |
| 2,521,208 | 9/1950 | Eaton | 229/134 X |
| 2,564,099 | 8/1951 | Dunning . | |
| 3,367,556 | 2/1968 | Whitby . | |
| 4,746,052 | 5/1988 | Schissrauter | 229/102 |
| 5,148,970 | 9/1992 | Johnston | 229/102 |
| 5,265,794 | 11/1993 | Johnston | 229/102 |

FOREIGN PATENT DOCUMENTS

| | | | |
|---|---|---|---|
| 000513495 | 11/1992 | European Pat. Off. | 229/134 |
| 914416 | 3/1982 | U.S.S.R. . | |

*Primary Examiner*—Gary E. Elkins
*Assistant Examiner*—Tri M. Mai
*Attorney, Agent, or Firm*—Michael McGreal

[57] ABSTRACT

The tamper evidency of a carton is increased by producing stronger end flap seals. This can be done by anchoring the adhesive onto at least one of the end flaps. In a preferred embodiment there is at least one lower flap with at least one recessed area, at least one seal flap with at least one aperture and at least one top flap. The lower flaps are folded inward followed by the seal flap. An adhesive is on the inner surface of the top flap which then is folded inward onto the seal flap. The adhesive flows through the at least one aperture in the seal flap and spreads outwardly in the at lest one recessed area below the at least one seal flap to become anchored to the seal flap. This is enchanted by a plurality of recesses in the at least one lower flap adjacent to the at least one aperture in the at least one seal flap. By being anchored to the seal flap and adhesively attached to the fiberboard underside of the top flap, a strong end seal is formed on the carton. This is highly tamper evident since flaps are permanently altered on opening the carton.

10 Claims, 5 Drawing Sheets

TAMPER EVIDENT CARTON SEAL

FIELD OF THE INVENTION

This invention relates to a carton and a tamper evident seal of a carton. More particularly, this invention relates to an adhesive structure tamper evident seal for a carton.

BACKGROUND OF THE INVENTION

There is a continual need for tamper evident seals for a carton. This is the case since the incidents of product tampering have been increasing. As a result, consumers are reluctant to purchase a product if it is not packaged in a way where it is very noticeable that a product has been the object of tampering. Also, merchants review their products and remove those that appear to have been objects of tampering. This has placed a demand on the development of effective tamper evident packaging.

A common way to make a carton, such as a carton that would contain a tube of a dentifrice, medicant or food, tamper evident is to seal the flaps with an adhesive and usually a hot melt adhesive. In order to open the carton and remove the tube, a person has to rip off one or more of the end flaps or at least alter them to the extent that is quite obvious that the carton has been opened. Also, it is necessary that the altering be such that once opened the carton cannot be readily resealed. That is, the carton cannot be resealed so as to disguise the fact that the carton has been opened. When the end flaps are adhesively sealed upon opening the carton is so altered that it cannot be resealed. Parts of the fiberboard of one flap are attached to another flap. The carton has been irreversibly altered.

However, there is a problem posed with some of the new carton materials. This particularly is the case with polymer coated fiberboard. Such a carton can have a high gloss finish and will be better able to weather moist and high humidity conditions. Also, the cartons have a neater and high quality performance. The problem is that adhesives do not readily adhere to such materials. This results in fake openings of the cartons from normal handling, and when purposely opened, the carton flaps are not sufficiently altered so as to be able to resealed. This problem is solved by the present invention. The solution is to provide at least one seal flap with at least one aperture so that adhesive will flow through such aperture and spread out below the aperture and in contact with one or more lower flaps. The lower flap or flaps will have one or more recesses to aid in the spreading out of the adhesive below the seal flap. At least one top flap then overlaps the at least one seal flap, with the lower surface of the seal flap having a fiberboard surface. That is, it does not have a polymer coated surface. The net result is that to open the carton the lower surface of the top flap and the seal flaps are permanently altered. They cannot be returned to their original sealed condition. Part of the fiberboard on the lower side of the top flap has been torn away and the apertures of the seal flaps have been damaged. When such a carton has been opened, it is very clear that it has been opened.

Although the use of apertures in flaps for the flow of glue through the flaps for better anchoring of the flaps together is shown in the prior art, such as in U.S. Pat. No. 837,324 and U.S. Pat. No. 2,084,106 and USSR Patent 914,416, there is not shown the presence of recesses in lower flaps so that the adhesive that flows through the apertures can spread out and better anchor to the lower flap. When the adhesive spreads out after flowing through an aperture, it cannot be pulled back through the aperture Also, the glue better adheres to the underside of the flap with the aperture.

BRIEF SUMMARY OF THE INVENTION

This invention is directed to a new technique for making fiberboard cartons tamper evident, and in particular, making cartons made from a polymer coated fiberboard tamper evident. This is accomplished by having one or more lower flaps overlayed by one or more seal flaps which are overlayed by one or more top flaps. The seal flaps have at least one aperture therethrough for the flow of an adhesive through the aperture into contact with the one or more lower flaps. The lower flaps will have one or more recesses in alignment with the apertures. The top flap then contacts the seal flap or flaps. Any adhesive that flows through the apertures of the seal flap or flaps flows out under the seal flap or flaps to become anchored under and to the seal flap or flaps and to a fiberboard exposed surface of the top flap. The anchoring of the adhesive to the seal flaps is an important part of the invention. In order to open the carton, the top flap and the seal flaps must be permanently altered. This makes any tampering with the product to be very evident.

Various adhesives can be used to seal the carton. A liquid adhesive is preferred, with a hot melt adhesive being most preferred. Hot melt adhesives are very preferred due to their quick set time. The preferred embodiment is for the lower flaps to have access adjacent the apertures of the seal flaps to enhance the flow of adhesive under seal flaps and to better anchor to seal flaps.

DETAILED DESCRIPTION OF THE DRAWINGS

The invention will be described with regard to the preferred embodiment which is a carton for a tube of dentifrice. Such cartons usually are square or rectangular in cross-section and are of a length of about 10 cm to 30 cm or more. The cartons will have a front panel, rear panel and two side panels connecting the front and rear panels. At the end of each panel is an end flap that forms the closed carton end. In the present invention some of the end flaps are modified to increase the sealability of the end flaps. This increased sealability is needed when the outer layer of the carton is a polymeric layer on the base fiberboard, such as a layer of a polyene such as polyethylene or polypropylene. In place of being a distinct layer, this polymeric layer can be a coating that is applied to the base fiberboard.

The problem is that by solely using adhesives, such as hot melt adhesives, the end flaps of a carton do not always remain well sealed and closed. This particularly is the case when the carton outer layer is a polymeric layer and the carton is subject to rough handling. When the carton seal also is the product tamper evidency, if the carton opens through rough handling, the product is open and it is not known if this was an accidental opening or the result of tampering. As a result, it usually is returned to the manufacturer for credit. As is evident, this is costly since the product must then be disposed of in conformance with regulations.

Figure 1:
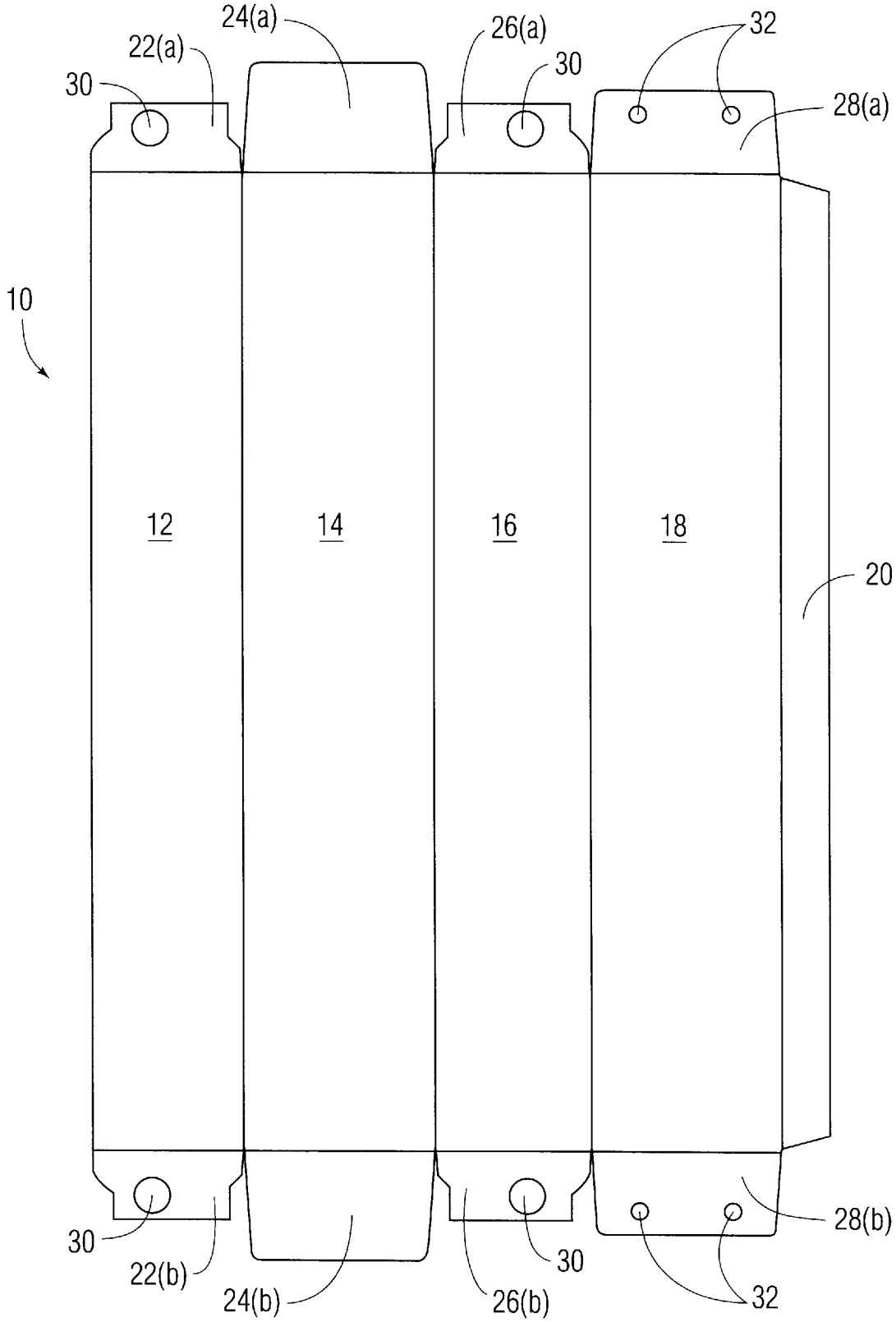
FIG. 1 is a planar view of a carton blank of the invention.

The present invention solves the problem by increasing the sealability of the end flaps of the cartons. This is accomplished by a modification of the end flaps. The carton blank 10 is shown in FIG. 1. These are side panel 12, top panel 14, side panel 16, bottom panel 18 and glue flap 20. Side panel 12 has lower flaps 22(*a*) and 22(*b*). Each of these flaps has a recessed area 30. Top panel 14 has top flaps 24(*a*) and 24(*b*). Side panel 16 has lower flaps 26(*a*) and 26(*b*). These flaps also have recessed areas 30. Bottom flap 18 has seal flaps 28(*a*) and 28(*b*). These flaps have apertures 32. These apertures overlay recessed areas 30 when the seal flap overlays the lower flaps.

Figure 2:
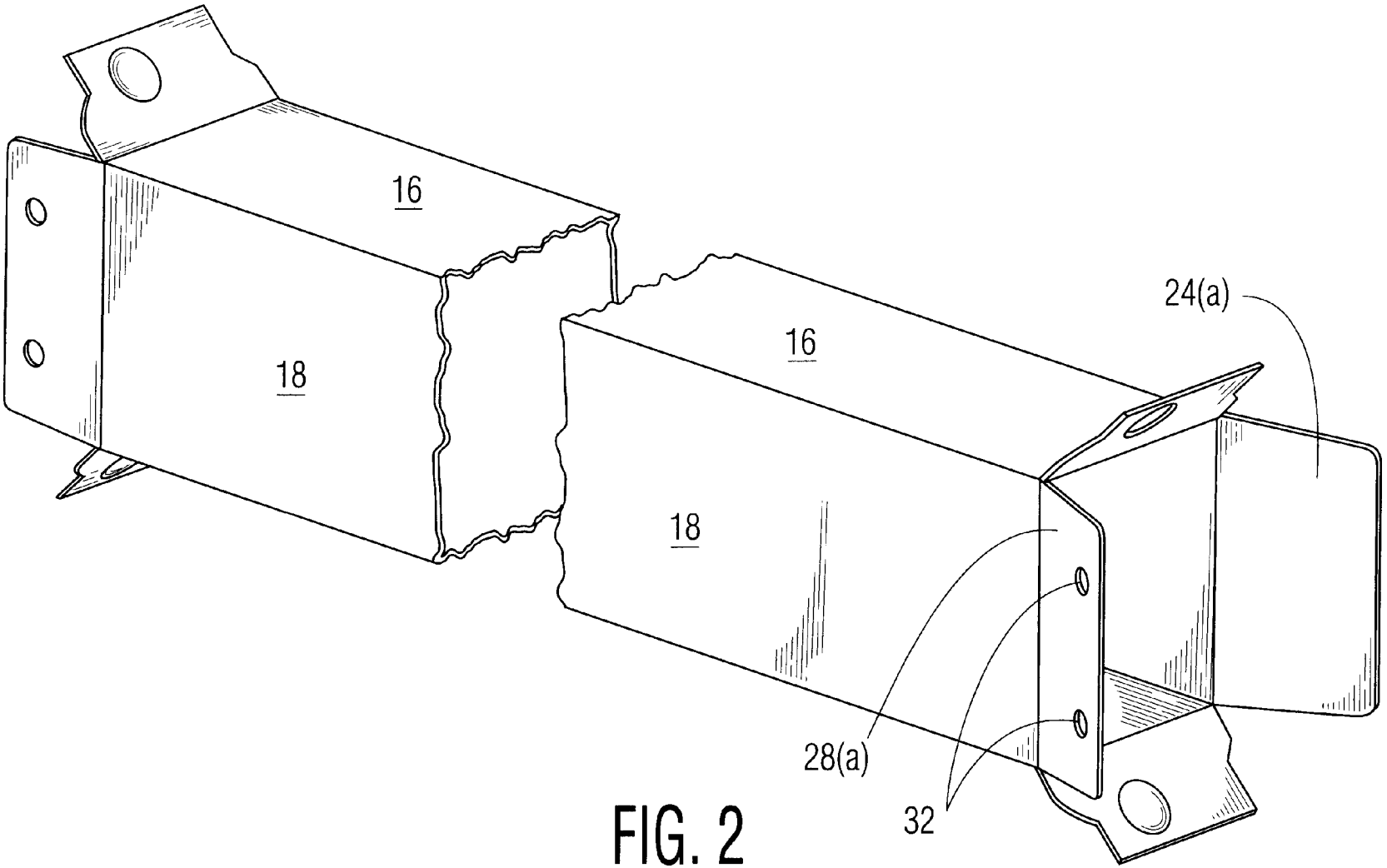
FIG. 2 is a perspective view of a carton constructed from the carton blanks of FIG. 1 with the end flaps open.

This carton blank is made into a carton in the usual way with the glue flap 20 contacting and being bonded to the under surface of side panel 12. FIG. 2 shows the carton in a formed state with the end flaps opened. The seal flap 28(*a*) and the aperture 32 are clearly shown.

Figure 3:
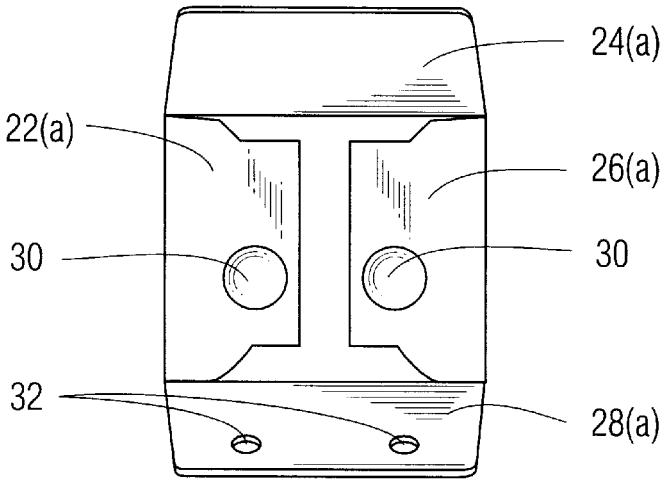
FIG. 3 is an end elevational view of the carton with the lower flaps closed showing recesses.
Figure 4:
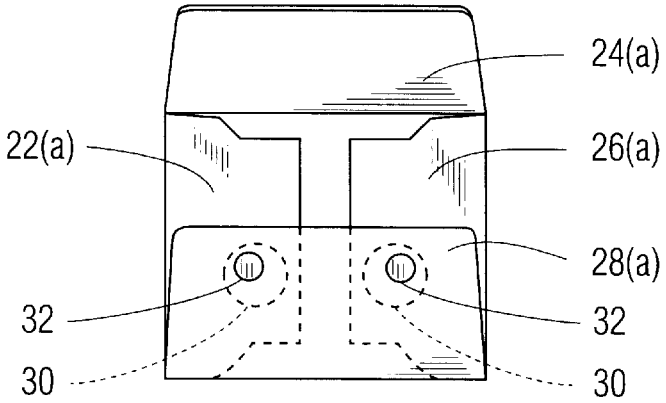
FIG. 4 is an end elevational view of the carton with a seal flap closed showing apertures and recesses.
Figure 5:
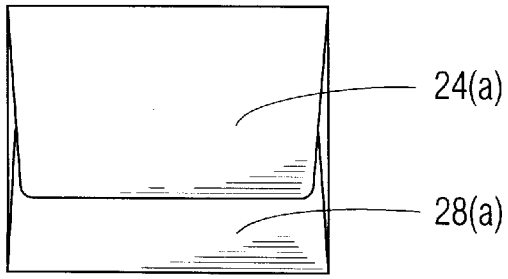
FIG. 5 is an end elevational view of the carton with a top flap closed.

FIG. 3 is an end view of the carton with the lower flaps 22(*a*) and 26(*a*) closed. Each of these flaps has a recessed area 30. Also shown is red flap 28(*a*) with apertures 32 and top flap 24(*a*). In FIG. 4 the seal flap 28(*a*) is folded inward and overlaps the lower flaps 22(*a*) and 26(*a*). The apertures 32 of the seal flaps overlay the recessed areas 30 of the lower flaps. In FIG. 5 the top flap 24(*a*) is shown closed over onto the seal flap 28(*a*) to seal the carton.

Figure 6:
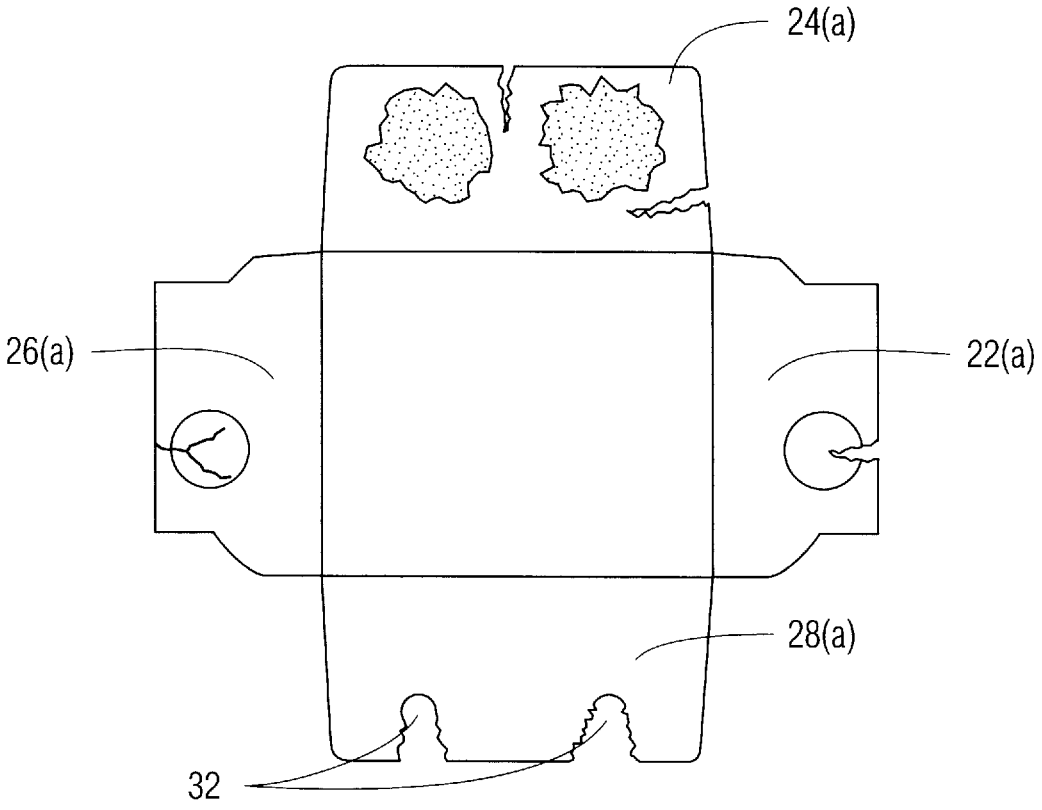
FIG. 6 is an end view of the carton opened after sealing.

Prior to the top flap being folded over onto the seal flap, a dose of adhesive is applied to the inner surface of the top flap. Preferably this is applied to the part of the inner surface of the top flap that will be adjacent the aperture 32 in the seal flap when the top flap is folded inward. In this way the adhesive will flow through the apertures and spread out under the seal flap in a recess 30. This is shown with the lower flaps 22(*b*) and 26(*b*) having aligned recesses 30. Then, when the adhesive sets, it is anchored to the underside of the seal flap and to the fiberboard surface of the top flap. Any opening of the carton will permanently deform the top flap and the seal flap and, in most cases, the lower flap. This is shown in FIG. 6 where the apertures 32 are torn and some of the fiberboard of the top flap 24(a) removed. This opening of the carton takes a positive force. It cannot be opened accidentally through rough handling such as being dropped.

Figure 8:
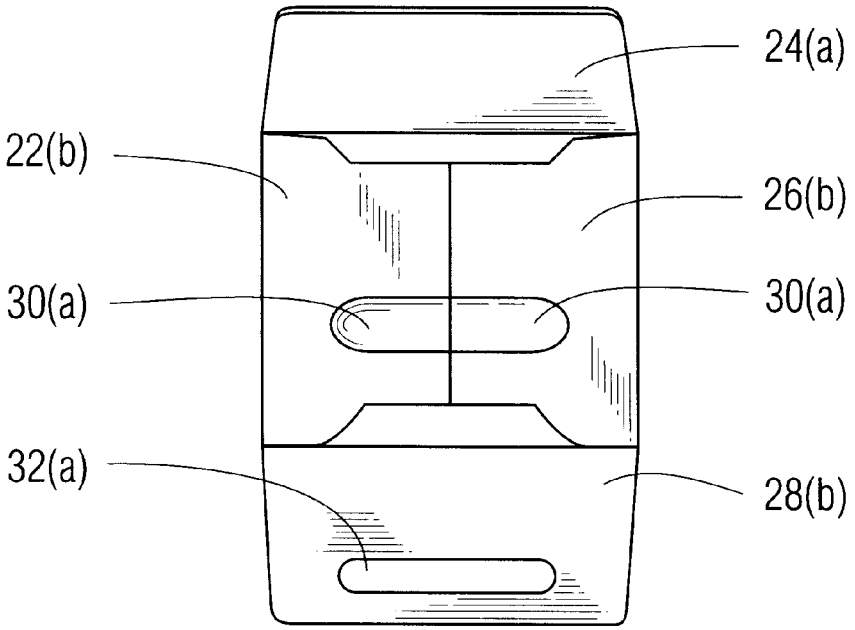
FIG. 8 is a further embodiment where the aperture is a slit and the recess in the lower flap is of a complementary shape.
Figure 9:
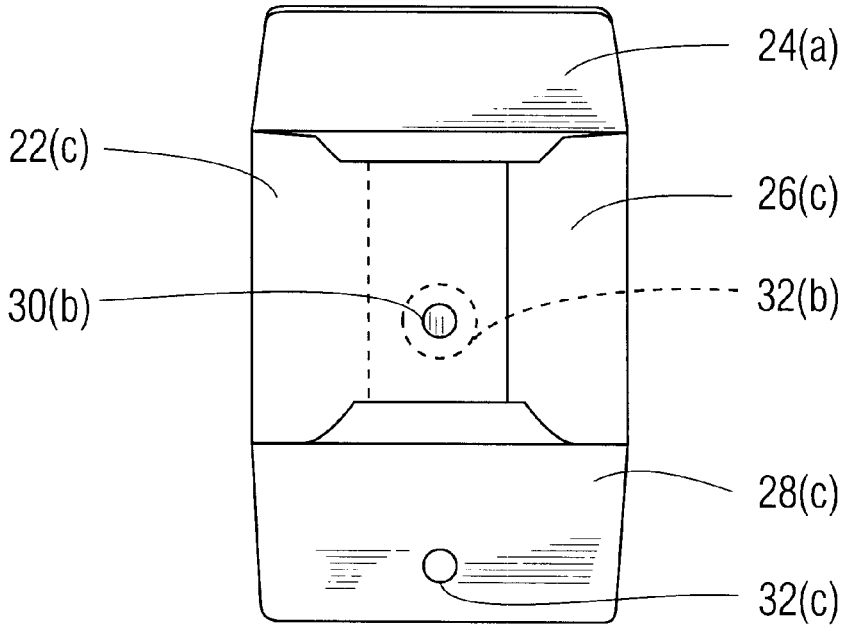
FIG. 9 is an embodiment where there is an aperture through the seal flap and top flap and a recess in the lower flap.

After one end of the carton has been sealed, a product, such as a tube of dentifrice, is placed in the carton and the flaps on the other end of the carton sealed. The flaps on each end preferably have the same structure and are closed in the same manner. For the embodiment of FIG. 1 to 5, the lower flaps 22(*b*) and 26(*b*) are folded inward followed by flap 28(*b*). Adhesive is applied to the inner surface of top flap 24(*b*) at some point up to this time and the top flap folded inward. The adhesive flows through apertures 32 in flap 28(*b*) and anchors the flaps closed. The carton now is in a finished form. The cartons of embodiments of FIGS. 8 and 9 are sealed in a similar manner.

The apertures 32 in the seal flaps and any other flap usually will be made when the carton blank is being formed. However, these can be made at any time up to the folding of the seal flaps inward. Likewise, recesses 30 in the lower flaps usually will be made when the carton blank is being formed.

This structure for the end flaps of a carton and the method of sealing provides a stronger seal for the end flaps. It can be used on cartons made from any materials. By anchoring the adhesive to the seal flap there is produced a strong seal that also increases the tamper evidency of the carton. In order to open the carton, more damage must be done to the carton flaps. Such damage is such that the carton cannot be resealed.

The adhesives can be any commonly used liquid or viscous adhesive. This can be liquid or viscous at room temperature or at an elevated temperature. It can be a reactive setting adhesive or it can be a temperature sensitive adhesive such as a hot melt adhesive. The only requirements are that it flow during application to the carton and the closing of the end flaps and then set to a solid sufficient to hold the flaps together.

Figure 7:
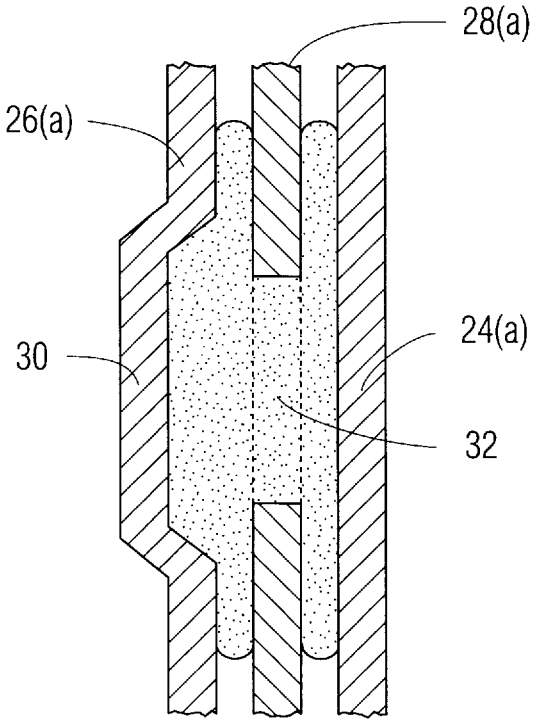
FIG. 7 is a cross-sectional view of the flaps of FIG. 5 through an aperture.

FIG. 7 shows the carton flaps in a cross-sectional view through an aperture 32 and with a recess 30. It is seen how the adhesive 40 flows through the aperture 32 to anchor under the seal flap 28(*a*).

In the embodiment of FIG. 8 the aperture is shown as a slit 32(*a*) in flap 28(*b*) and the recess shown of a complementary shape 30(*a*) in flaps 22(*b*) and 26(*b*). In this embodiment seal flaps 22(*b*) and 26(*b*) are in a contacting engagement when closed.

In the embodiment of FIG. 9 the lower flaps 22(*c*) and 26(*c*) overlap with flap 22(*c*) having a recess 30(*b*) and flap 26(*a*) having an aperture 32(*b*). Further, seal flap 28(*b*) has an aperture 32(*c*) that is in alignment with aperture 32(*b*) and recess 30(*b*). Top flap 24(*a*) will close and seal the carton. In this embodiment adhesive will pass through one lower flap and a seal flap. Adhesive will be above and below the seal flap and one of the lower flaps. In addition, flap 24(*a*) can also have a recess in alignment with aperture 32(*c*) so that adhesive will be anchored above and below the seal flap.

Various modifications of the structure and methods disclosed in this application are possible. However, such modifications utilize the inventive concepts and are within the present invention.

What is claimed is:

1. A carton with an enhanced tamper evident seal comprising a carton having a front surface, a rear surface with two side surfaces, each side surface attached to the front surface and the rear surface to form an elongated channel, a plurality of flaps at each end of said elongated channel, said flaps including at least one lower flap having at least one debossed recess thereon, at least one seal flap and at least one top flap, at least one aperture in said at least one seal flap for the flow of an adhesive therethrough, said at least one seal flap overlaying said at least one lower flap with at least one recess thereon, said at least one recess in alignment with said at least one aperture said at least one top flap overlaying said at least one seal flap, a polymer layer as an outer layer and a fiberboard layer as an inner layer on said front surface, rear surface, side surfaces, at least one lower flap, at least one seal flap and at least one too flap, said adhesive contacting the fiberboard layer of said top flap and the fiberboard layer of said at least one seal flap.

2. A carton as in claim 1 wherein said at least one seal flap adjacent to said at least one aperture has at least one recess so that adhesive that flows through said at least one aperture flows into said at least one recess and spreads to at least partially fill said at least one recess.

3. A carton as in claim 1 wherein there are two lower flaps, one seal flap and one top flap.

4. A carton with an enhanced tamper evident seal comprising a carton having a front surface, a rear surface with two side surfaces, each side surface attached to the front surface and the rear surface to form an elongated channel, a plurality of flaps at each end of said elongated channel, said flaps including at least one lower flap having at least one debossed recess thereon, at least one seal flap and at least one top flap, at least two apertures in said at least one seal flap for the flow of an adhesive therethrough, said at least one seal flap overlaying said at least one lower flap with said recess located below a respective aperture in said seal flap when said seal flap is closed over onto said lower flaps and said at least one top flap overlaying said at least one seal flap.

5. A carton as in claim 4 wherein there is a polymer layer as an outer layer on said front surface, rear surface, side surfaces, at least one lower flap, at least one seal flap and at least one top flap over a fiberboard layer.

6. A carton as in claim 5 wherein said recess in said at least one seal flap adjacent to said at least one aperture in said at least one seal flap so that adhesive that flows through said at least one aperture flows into said at least one recess and spreads to at least partially fill said at least one recess and contact the fiberboard layer of said at least one seal flap.

7. A carton as in claim 4 wherein said at least one seal flap adjacent to said at least one aperture has at least one recess so that adhesive that flows through said at least one aperture flows into said at least one recess and spreads to at least partially fill said at least one recess.

8. A carton as in claim 4 wherein there are two lower flaps, one seal flap and one top flap.

9. A carton as in claim 4 wherein each aperture contains an adhesive, some of said adhesive above and below said aperture.

10. A carton as in claim 9 wherein said adhesive is a hot melt adhesive.

* * * * *